United States Patent [19]

Lineberry et al.

[11] Patent Number: 4,522,044

[45] Date of Patent: Jun. 11, 1985

[54] ANKLE AND ARCH SUPPORT SOCK

[75] Inventors: Roger D. Lineberry; Harper Shields, both of Burlington, N.C.

[73] Assignee: Kayser-Roth Hosiery, Inc., Burlington, N.C.

[21] Appl. No.: 581,687

[22] Filed: Feb. 21, 1984

[51] Int. Cl.[3] ..... A41B 11/02; D04B 9/46

[52] U.S. Cl. ..... 66/185; 66/172 E; 66/178 A

[58] Field of Search ..... 66/178 A, 185, 172 E, 66/183, 186, 187, 194, 190

[56] References Cited

U.S. PATENT DOCUMENTS

| | | | |
|---|---|---|---|
| 2,420,771 | 5/1947 | Crawford et al. | 66/172 E |
| 3,162,029 | 12/1964 | Laws et al. | 66/172 E |
| 3,392,553 | 7/1968 | Burleson | 66/178 A X |
| 3,461,695 | 8/1969 | Knohl | 66/178 A |
| 4,253,317 | 3/1981 | Howard et al. | 66/186 |

*Primary Examiner*—Ronald Feldbaum

*Attorney, Agent, or Firm*—Bell, Seltzer, Park & Gibson

[57] ABSTRACT

Elastic yarn is incorporated in different manners in two circumferential sections of the ankle and arch portions of the sock to provide compressive force and support to these areas of the wearer. The elastic yarn is incorporated in spaced-apart wales of each course of the ankle and arch portions and is floated inside of plural wales in the rear half of successive courses in the ankle and lower half of the arch to form mock ribs extending around substantially the rear half of the sock. The elastic yarn is incorporated in every other wale of single alternating courses and in the remaining wales of single intervening courses in the front half of the ankle and upper half of the arch to form a diamond pattern extending around substantially the front half of the sock. By incorporating the elastic yarn in two different manners in every course, the proper amount of compressive force and support is provided on the ankle and arch of the wearer.

6 Claims, 2 Drawing Figures

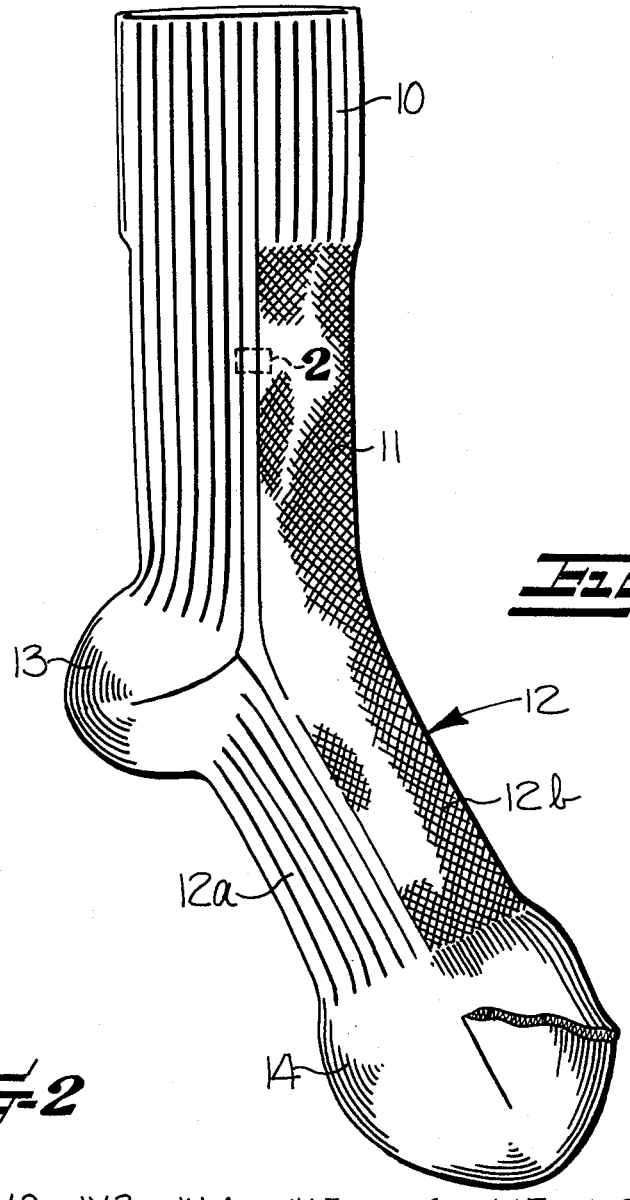
Fig-1
Fig-2
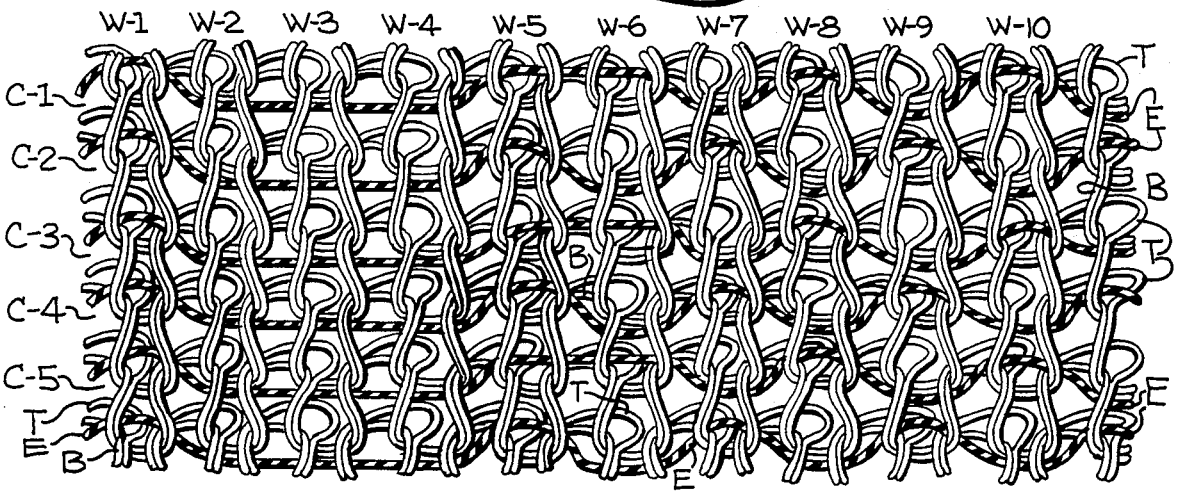

ANKLE AND ARCH SUPPORT SOCK

FIELD OF THE INVENTION

This invention relates generally to a support sock and more particularly to a support sock for the ankle and arch portion of the foot, such sock having elastic yarn incorporated in a particular manner in both the ankle and arch portions to provide compressive force and support to the ankle and arch of the wearer.

BACKGROUND OF THE INVENTION

It is generally known to incorporate elastic, rubber or spandex yarn in socks for a variety of reasons. For example, such elastic yarns are used to form mock-rib fabric patterns for aesthetic purposes, and in other instances are used in order to impart compressive support characteristics thereto. In some cases, the elastic yarn is incorporated differently in different areas of the sock to vary the stretchability or compressive characteristics of different areas of the sock. For example, U.S. Pat. No. 3,386,270 discloses knitting and floating covered spandex yarn in spaced courses throughout the leg portion of a sock while knitting the spandex yarn in every wale in the calf portion to increase the stretchability of the sock in the calf portion for better wearer comfort.

U.S. Pat. Nos. 2,102,368 and 2,219,235 disclose several arrangements for incorporating elastic yarn in the arch covering portion of the foot of a sock to provide arch supporting characteristics to the sock. All of these arrangements have the support characteristic limited to the arch area. Although these prior types of socks have been effective for providing support in the areas proposed, they have not been particularly adapted for providing the proper amount of support in both the ankle and arch areas.

SUMMARY OF THE INVENTION

With the foregoing in mind, it is an object of the present invention to provide a sock with elastic yarn incorporated in a particular manner in both the ankle and arch areas to provide the proper amount of compression and support on the ankle and arch of the wearer.

In accordance with the present invention, the leg and foot portions of the sock are integrally knit of a body yarn which forms successive courses of wales of stitch loops extending throughout the ankle and arch portions. An elastic yarn is incorporated in the courses of body yarn in both the ankle and arch portions to provide two circumferential sections of different fabric structures characterized by the manner in which the elastic yarn is incorporated therein. The rear section includes a mock-rib fabric structure formed by the elastic yarn being incorporated in spaced-apart wales and floated inside of plural wales between the spaced-apart wales in substantially the rear half of successive courses in the ankle portion. A diamond or waffle pattern fabric structure is formed in the front section of the ankle by incorporating the elastic yarn in alternating wales and floating inside of intervening wales of alternating courses and in intervening wales and floating the remaining wales inside of alternating wales of intervening courses in the front half or section of the ankle. The sock may be provided with a reciprocatorily knit heel pocket and the medial portion of the foot is knit in the same manner as the ankle so that the upper half of the foot is provided with the diamond or waffle pattern while the lower half or arch portion of the foot is provided with the mock rib pattern.

It is preferred that the entire inner surface of the sock be provided with terry loops to provide a smooth cushion comfort to the foot and leg of the wearer. The incorporation of the elastic yarn in spaced-apart wales with plural wales therebetween in the rear half of the sock and the incorporation of the elastic yarn in every other wale in the front half of the sock provides the desired amount of compressive force and support on both the ankle and the arch of the wearer. The amount of compression provided by floating an elastic yarn over multiple wales is greater than the amount of compression provided by floating the elastic yarn over only single wales. By providing two circumferential sections of different fabric structure, illustrated as being in the front and rear halves of the sock, two types of compression are provided in each course in both the ankle and arch areas so that the desired amount of compressive force is obtained in both the ankle and arch portions of the sock.

BRIEF DESCRIPTION OF THE DRAWINGS

Other objects and advantages will appear as the description proceeds when taken in connection with the accompanying drawings, in which FIG. 1 is a side elevational view of the support sock of the present invention, in flattened condition, the opposite side being identical to the side shown and FIG. 2 is an enlarged fragmentary elevational view of the small portion of the fabric enclosed in the dotted rectangle 2 in FIG. 1 and illustrating the different methods of incorporating the elastic yarn in the rear and front halves of the courses.

DESCRIPTION OF THE ILLUSTRATED EMBODIMENT

As illustrated in FIG. 1, the support sock includes a conventional type of mock rib cuff 10 which is knit of a body yarn with an elastic yarn being inlaid in a three-by-one manner. A short leg portion 11 is adapted to cover at least the ankle of the wearer and a foot portion, broadly indicated at 12, is integrally knit with the leg 11 and includes a heel pocket 13 and a toe pocket 14. The medial portion of the foot 12 is divided into a lower sole or arch portion **12*a* and an upper instep 12*b*, each of which encompasses substantially one-half of the wales of the courses in the medial portion of the foot 12**.

As best shown in FIG. 2, the elastic yarn E is illustrated as being incorporated with the body yarn B and the terry yarn T by being inlaid therein. However, it is to be understood that the elastic yarn E could be knit in spaced wales and in plated relationship with the body yarn B and the terry yarn T, if desired. The elastic yarn E is illustrated as being inlaid in spaced-apart wales W-1 and W-5 and floated inside of the plural wales W-2 through W-4 of successive courses C-1 through C-5. The elastic yarn E is inlaid in this manner in the wales extending around the rear half of the leg 11 of the sock. The elastic yarn E is inlaid in the same spaced-apart wales W-1 and W-5 in what is known as a three-by-one manner throughout the entire rear half of the leg 11 of the sock to produce a mock-rib fabric structure therein.

The elastic yarn E is inlaid in every other wale of single alternating courses, as illustrated in wales W-6, W-8 and W-10 of courses C-1, C-3 and C-5 and inlaid in the remaining wales of intervening courses, as illustrated in wales W-7 and W-9 of courses C-2 and C-4.

The alternate inlaying and floating of the elastic yarn E in every other wale and in staggered relationship from course to course, as illustrated in the right-hand side of FIG. 2, forms a diamond or waffle pattern fabric structure extending around substantially the front half of the leg 11. The terry yarn T is knit in plated relationship with the body yarn B and preferably forms inwardly extending terry loops throughout both the entire leg 11 and foot 12, including the heel 13 and toe 14. The inwardly facing terry loops provide smooth cushioning comfort against the leg of the wearer. The heel 13 is knit in the usual manner with gradual narrowing and then widening of the partial courses. The two circumferential sections formed by the lower and upper portions 12*a* and 12*b* are then knit in the same manner as the ankle or leg 11.

In the lower or arch portion 12*a*, the elastic yarn E is inlaid in a three-by-one manner and in the same manner as the rear half of of the leg 11. In the upper or instep portion 12*b*, the elastic yarn is inlaid in a one-by-one manner and is staggered or offset from course to course. By inlaying the elastic yarn in a different manner in the front half of the sock from the manner in which it is inlaid in the rear half of the sock to produce two circumferential sections of different fabric structure, it is possible to obtain the desired amount of compressive force in both the ankle and arch portions of the sock. A lesser amount of elastic yarn is incorporated in the rear half of each of the courses than the amount of elastic yarn incorporated in the front half because the longer floats of elastic yarn in the rear half require a lesser length of yarn than the undulating path of the inlaid elastic yarn in the front half of the sock where the elastic yarn is inlaid in a one-by-one manner.

If each course of the leg and foot included the elastic yarn inlaid in a one-by-three manner throughout, as indicated in the left-hand portion of FIG. 2, a greater than desired amount of compressive force would be applied to the ankle and arch of the wearer. On the other hand, if each course contained the elastic yarn inlaid in a one-by-one manner throughout, as illustrated in the right-hand portion of FIG. 2, a greater amount of elastic yarn would be incorporated in each course and there would not be a sufficient amount of compressive force on the ankle and arch of the wearer. By combining the two different methods of inlaying the elastic yarn in every course, the proper amount of compressive force is obtained to apply the proper amount of support on the ankle and arch of the wearer. Of course, the amount of compressive force can be varied by increasing or decreasing the width of either the mock-rib fabric structure or the diamond pattern fabric structure.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. An ankle and arch support sock including a leg portion adapted to cover at least the ankle of the wearer, and a foot portion with a central portion adapted to cover the arch of the wearer, said leg and foot portions being integrally knit of body yarn forming successive courses of wales of stitch loops, and an elastic yarn incorporated in the courses of the body yarn in said ankle and arch portions, said ankle and arch portions having two circumferential sections of different fabric structure characterized by the manner in which the elastic yarn is incorporated therein, one of said sections having a mock-rib fabric structure formed by said elastic yarn being incorporated in spaced-apart wales and floated inside plural wales between said spaced-apart wales, the other of said sections having a diamond pattern fabric structure formed by said elastic yarn being incorporated in alternating wales and floated inside intervening wales of alternating courses and being incorporated in the intervening wales and floated inside the alternating wales of the intervening courses.

2. An ankle and arch support sock according to claim 1 wherein each of said two circumferential sections of different fabric structure extends around substantially one-half of said ankle and arch portions.

3. An ankle and arch support sock according to claim 1 wherein said mock-rib fabric structure is formed by said elastic yarn being incorporated in a three-by-one manner.

4. An ankle and arch support sock according to claim 1 including a terry yarn knit in plated relationship with said body yarn in said ankle and arch portions and forming terry loops extending inwardly of said ankle and arch portions.

5. An ankle and arch support sock according to claim 1 wherein said mock-rib fabric structure extends along the rear half of said ankle and the lower half of said arch portion, and wherein said diamond pattern fabric structure extends along the front half of said ankle and the upper half of said arch portion.

6. An ankle and arch support sock including a leg portion adapted to cover at least the ankle of the wearer, and a foot portion with a central portion adapted to cover the arch of the wearer, said leg and foot portions being integrally knit of body yarn forming successive courses of wales of stitch loops, and an elastic yarn incorporated in the courses of the body yarn in said ankle and arch portions, said ankle and arch portions having two circumferential sections of different fabric structure characterized by the manner in which the elastic yarn is incorporated therein, one of said sections extending around the rear half of said ankle portion and the lower half of said arch portion and having a mock-rib fabric structure formed by said elastic yarn being incorporated in a three-by-one manner, the other of said sections extending around the front half of said ankle portion and the upper half of said arch portion and having a diamond pattern fabric structure formed by said elastic yarn being incorporated in a one-by-one manner.

* * * * *